US006149260A

United States Patent [19]

Minakuti

[11] Patent Number: 6,149,260

[45] Date of Patent: Nov. 21, 2000

[54] INK JET RECORDING APPARATUS CAPABLE OF PRINTING IN MULTIPLE DIFFERENT DOT SIZES

[75] Inventor: Jun Minakuti, Sakai, Japan

[73] Assignee: Minolta Co., Ltd., Osaka, Japan

[21] Appl. No.: 09/009,989

[22] Filed: Jan. 21, 1998

[30] Foreign Application Priority Data

Jan. 21, 1997 [JP] Japan ..... 9-008784

[51] Int. Cl.[7] ..... B41J 2/205

[52] U.S. Cl. ..... 347/15

[58] Field of Search ..... 347/15, 9, 10, 347/5

[56] References Cited

U.S. PATENT DOCUMENTS

| | | | |
|---|---|---|---|
| 4,369,455 | 1/1983 | McConica et al. | 347/15 |
| 4,503,444 | 3/1985 | Tacklind | 347/15 |
| 4,746,935 | 5/1988 | Allen | 347/15 |
| 5,208,605 | 5/1993 | Drake | 347/15 |
| 5,412,410 | 5/1995 | Rezanka | 347/15 |
| 5,790,139 | 8/1998 | Umeno et al. | 347/15 |
| 5,790,152 | 8/1998 | Harrington | 347/15 |

FOREIGN PATENT DOCUMENTS

| | | | |
|---|---|---|---|
| 437062 | 12/1990 | European Pat. Off. | 347/15 |
| 0437062 | 7/1991 | European Pat. Off. . | |

*Primary Examiner*—John Barlow
*Assistant Examiner*—Juanita Stephens
*Attorney, Agent, or Firm*—Sidley & Austin

[57] ABSTRACT

An ink jet printing head that can eject ink droplets forming dot sizes in any of a plurality of differing dot sizes. The plurality of differing dot sizes has a low level range and a high level range. The ink jet printing head has a plurality of small size nozzles and a plurality of large size nozzles. The plurality of small size nozzles eject ink droplets capable of forming a plurality of differing dot sizes in a low level range. The plurality of large size nozzles eject ink droplets capable of forming a plurality of differing dot sizes in a high level range. The change in dot size between adjacent dot sizes of the low level range is different from the change in dot size between adjacent dot sizes of the high level range.

32 Claims, 13 Drawing Sheets

| TONE LEVEL | PEAK VOLTAGE(V) |
|---|---|
| 0 | 00.0 |
| 1 | 15.4 |
| 2 | 16.8 |
| 3 | 18.2 |
| 4 | 19.6 |
| 5 | 21.0 |
| 6 | 22.4 |
| 7 | 23.8 |
| 8 | 30.8 |
| 9 | 39.2 |

SMALL SIZE NOZZLE

LARGE SIZE NOZZLE

| TONE LEVEL | PEAK VOLTAGE(V) |
|---|---|
| 0 | 00.0 |
| 1 | 14.8 |
| 2 | 16.0 |
| 3 | 17.4 |
| 4 | 19.0 |
| 5 | 21.6 |
| 6 | 24.4 |
| 7 | 28.0 |
| 8 | 33.0 |
| 9 | 39.2 |

INK JET RECORDING APPARATUS CAPABLE OF PRINTING IN MULTIPLE DIFFERENT DOT SIZES

BACKGROUND OF THE INVENTION

1. Field of the Invention

The present invention relates to an ink jet recording apparatus expressing tones by ejecting ink droplets of a plurality of sizes.

2. Description of the Background Art

There have been various ink jet recording apparatuses which record images on a recording medium by ejecting ink droplets from the nozzle. Such an ink jet recording apparatus is disclosed for example by EPA 0437062. In the ink jet recording apparatus disclosed by the document, the size of ink droplets is changed in order to reproduce an image having tones such as a photographic image. In order to faithfully reproduce the tones of an image, the size of ink droplets must be precisely controlled depending upon the tones of pixels to be reproduced. The size of ink droplets is changed by controlling the value of the driving voltage used to drive the recording head. A high driving voltage should be applied to drive the recording head to cause large size ink droplets to be ejected, but it is difficult to precisely control the driving voltage such that ink droplets are ejected at a desired size. Conversely, the response of the driving circuit which applies the driving voltage is lowered when small size ink droplets are to be ejected.

Some apparatuses have two different size nozzles for large and small ink droplet sizes.

SUMMARY OF THE INVENTION

It is therefore one object of the invention to provide an ink jet head capable of high tone expression.

Another object of the invention is to provide an ink jet head capable of alleviating the load of a driver.

Yet another object of the invention is to provide an ink jet head capable of high tone expression and alleviation of the load of a driver.

A still further object of the invention is to provide a method printing in an ink jet recording apparatus permitting of high tone expression.

A still further object of the invention is to provide a method of printing in an ink jet recording apparatus permitting alleviation of the load of a driver.

An additional object of the invention is to provide a method of printing in an ink jet recording apparatus permitting high tone expression and alleviation of the load of a driver.

The above-objects of the invention are achieved by an ink jet recording apparatus including the following elements.

More specifically, the ink jet recording apparatus according to the invention includes a transport mechanism for transporting a recording medium, a printing head for ejecting ink droplets onto the recording medium being transported, thereby forming dots on the recording medium. The printing head can eject ink droplets in a plurality of serial tones, dots formed in the levels are different in size, and the difference of the sizes of dots between adjacent levels in a low tone range is different from the difference of the sizes of dots between adjacent levels in a high tone range.

There is a difference between the dot sizes of the adjacent levels in the low level range and the dot sizes of the adjacent levels in the high level range. In general, the low level range attracts much attention from human eyes, while conversely the high level range attracts less attention. Therefore, the printing head can be driven appropriately to correspond to the low level range which attracts more attention by human eyes and provides a good driver response, and also to correspond the high level range which attracts less attention and provides high driver precision. As a result, the load of the driver can be alleviated while high tone expression is maintained.

According to another aspect of the invention, a method of printing in an ink jet recording apparatus includes the steps of inputting image data having a plurality of tones, driving the printing head depending upon the image data inputted during in the inputting step, thereby forming ink dots on a recording medium for printing by ejecting ink droplets from the printing head. The size of ink dots formed in the printing step changes depending upon the tone of the image data.

The change ratio of dot sizes in the low tone range is different from the change ratio of dot sizes in the high tone range.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

This application is based on Japanese Patent Application No. 9-008784, the contents of which is hereby incorporated by reference.

An ink jet recording apparatus according to a first embodiment of the invention will be now described in conjunction with the accompanying drawings.

Figure 1:
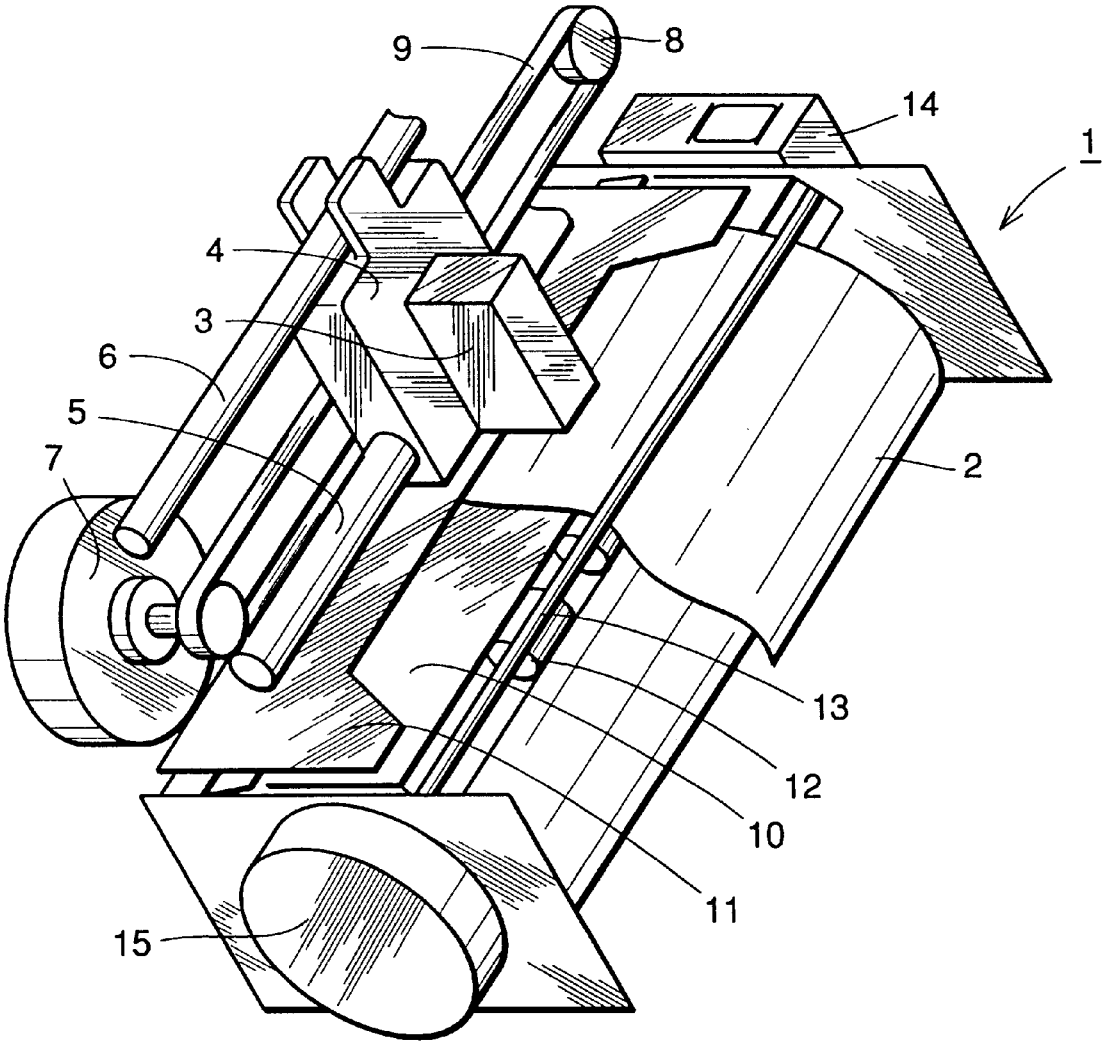
FIG. 1 is a schematic perspective view generally showing an ink jet recording apparatus according to one embodiment of the invention.

Referring to FIG. 1, ink jet recording apparatus 1 includes an ink jet type recording head 3, a carriage 4 which carries recording head 3, rocking shafts 5 and 6 for reciprocating carriage 4 in parallel to the recording surface of a recording sheet 2 such as a paper sheet and a resin film, a drive motor 7 to drive carriage 4 to reciprocate along rocking shafts 5 and 6, a timing belt 9 for changing the rotation of drive motor 7 into the reciprocating movement of carriage 4, and an idle pulley 8.

Ink jet recording apparatus 1 also includes a platen 10 which also serves as a guide plate to guide recording sheet 2 along a transport path, a paper holding plate 11 which presses recording sheet 2 against platen 10 to prevent the sheet from being lifted, a discharge roller 12 for discharging recording sheet 2, a spur roller 13, a regaining system 14 for regaining a good state from the ink ejection fault state of recording head 3, and a paper feeding knob 15 for manually feeding recording sheet 2.

Recording sheet 2 is fed manually or by a paper feeding device such as cut-sheet feeder into a recording portion in which recording head 3 opposes platen 10. At the time, the amount of rotation of a paper feeding roller (not shown) is controlled to control the transportation of the sheet into the recording portion.

A piezoelectric element is used for recording head 3. The piezoelectric element is supplied with a voltage and deforms. The deformation changes the volume of a channel filled with ink. The change in volume causes ink to be ejected from the nozzle provided at the channel, and images are recorded onto recording sheet 2.

Recording head 3 records images using inks of four colors, Y (yellow), M (magenta), C (cyan), and K (black).

Carriage 4 scans in the widthwise (transverse) direction of recording sheet 2, and recording head 3 attached to carriage 4 records images for one line. Each time images for one line are recorded, recording sheet 2 is fed in the longitudinal direction for subscanning, and the next line is recorded.

Figure 2:
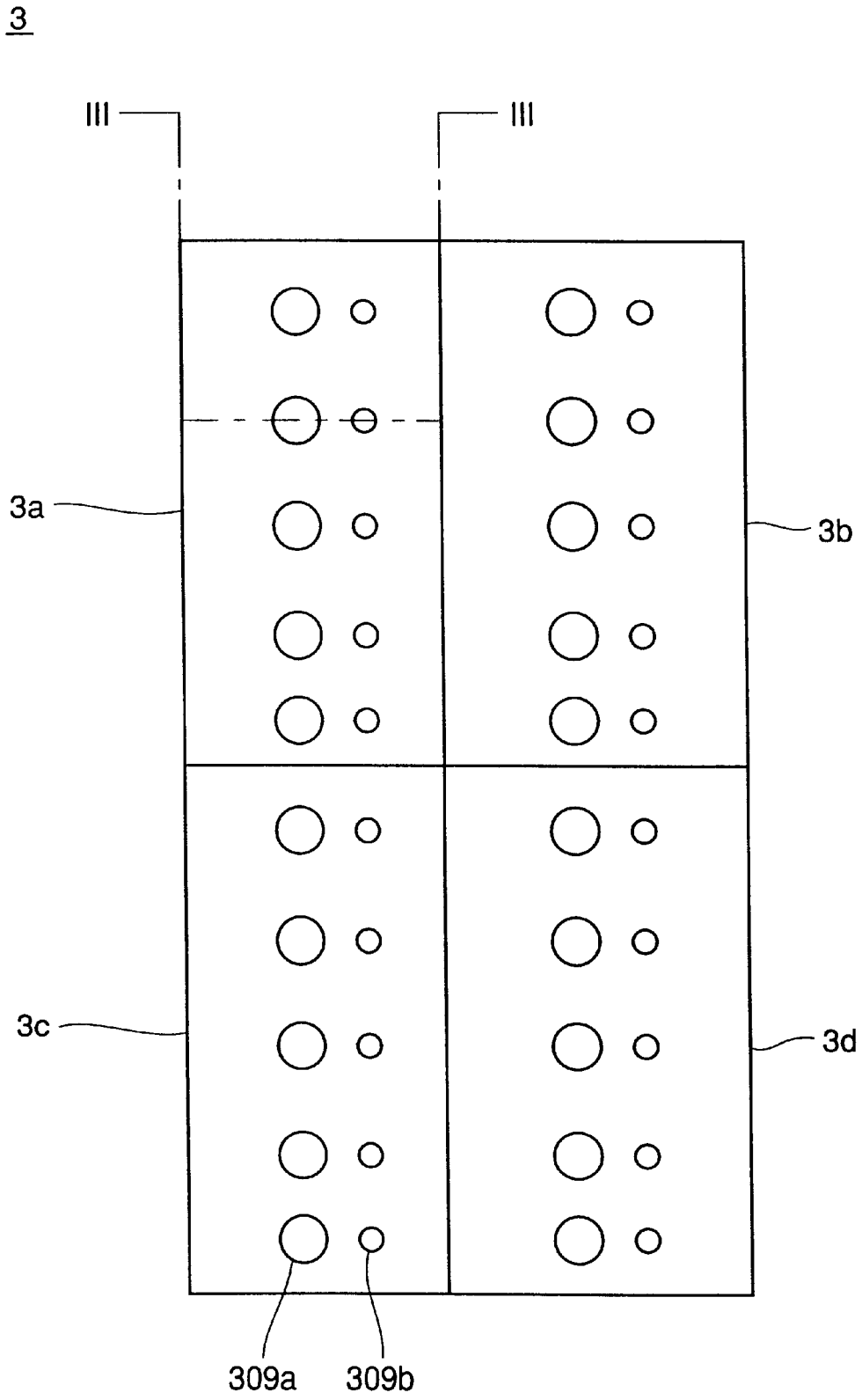
FIG. 2 is a plan view for use in illustration of the structure of a recording head.
Figure 3:
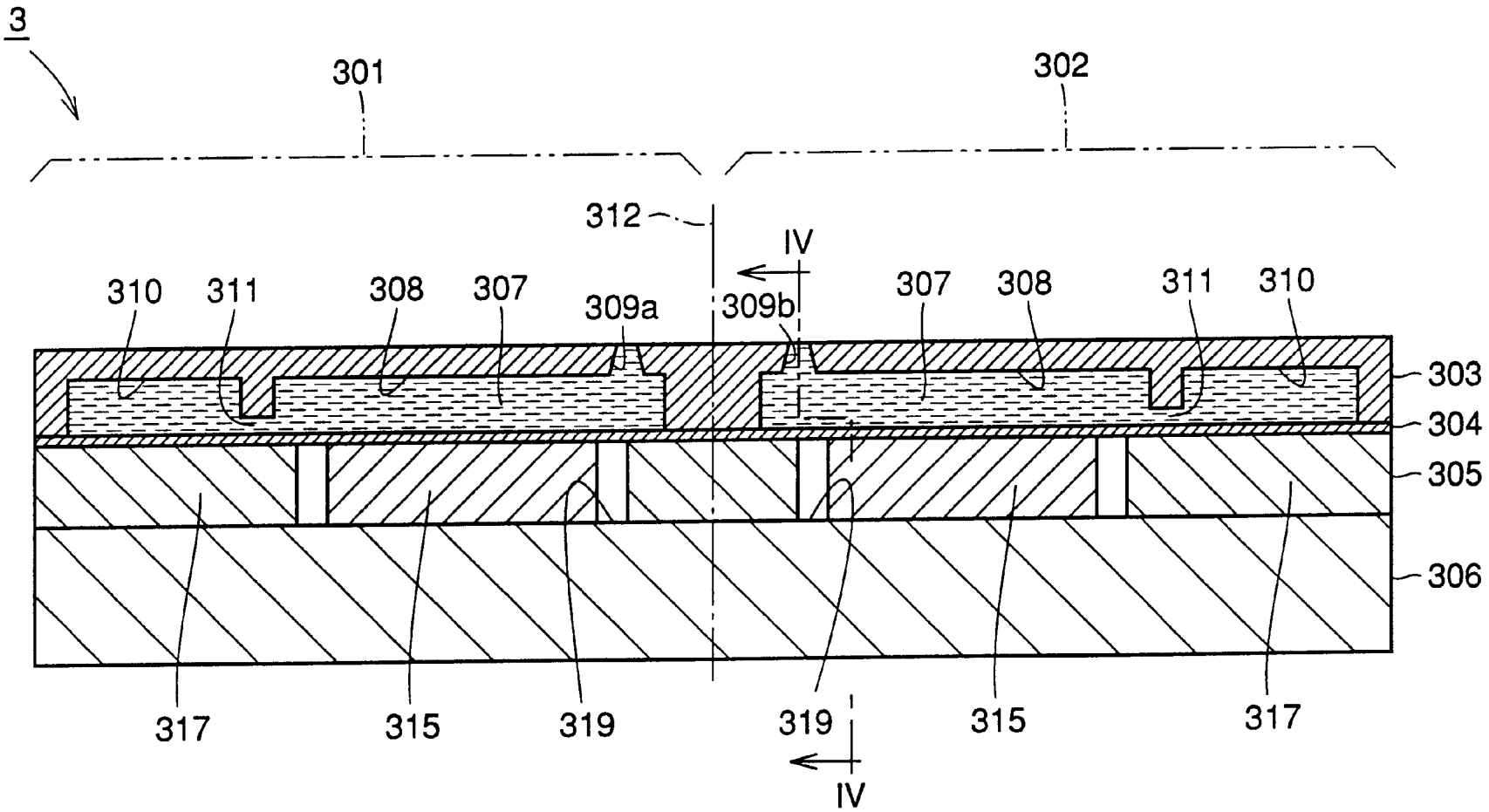
FIG. 3 is a cross sectional view taken along line III—III in FIG. 2.
Figure 4:
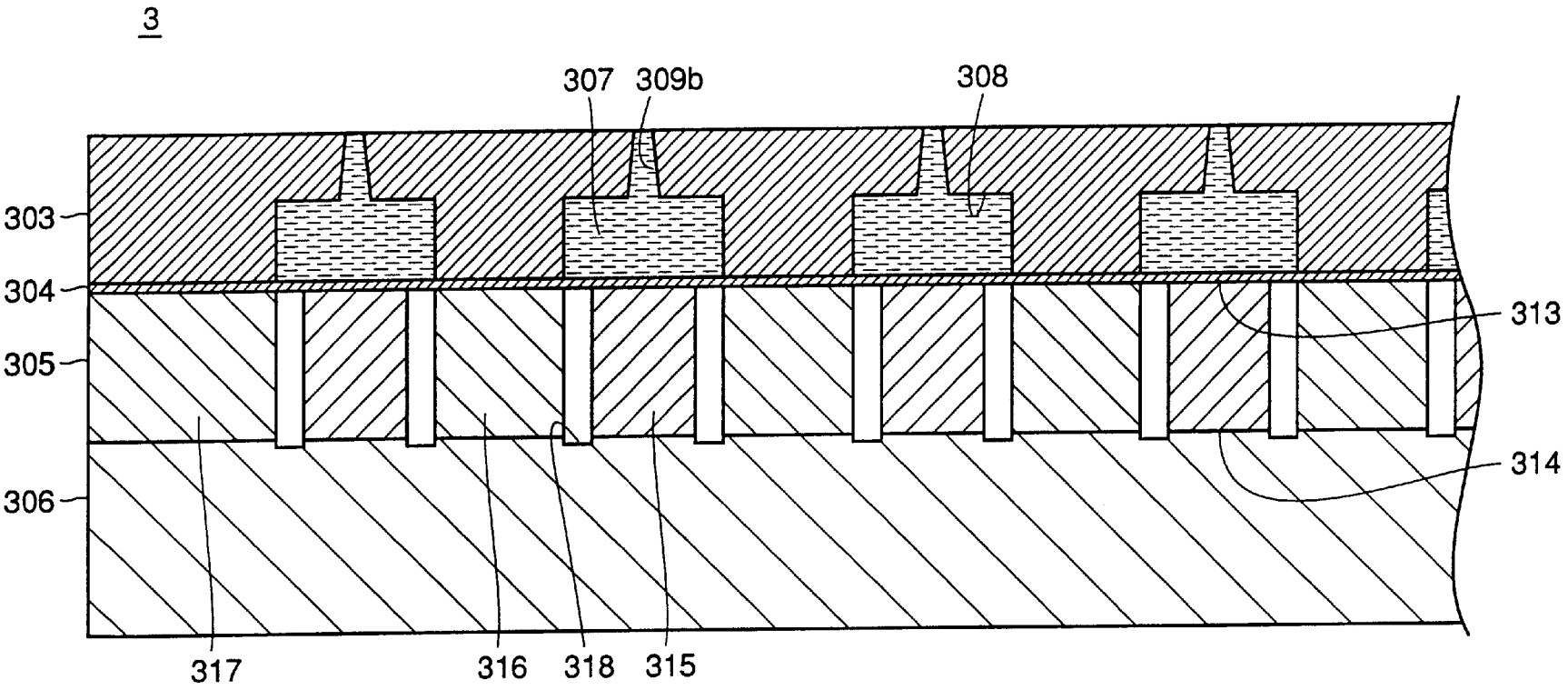
FIG. 4 is a cross sectional view taken along line IV—IV in FIG. 3.

FIGS. 2 to 4 illustrate the structure of recording head 3.

Referring to FIGS. 2 to 4, recording head 3 is formed of recording head portions 3*a* to 3*d* corresponding to Y, M, C and K, respectively. Recording head portions 3*a* to 3*d* are each formed of a large size head portion 301 and a small size head portion 302. Large size head portion 301 and small size head portion 302 are formed by integrally placing upon one another a channel plate 303, a partitioning wall 304, a vibrating plate 305, and a base plate 306.

Channel plate 303 is formed of a metal or composite resin. Its surface opposite to partitioning wall 304 is finely processed by means of electroforming or photolithography, and large size head portion 301 and small size head portion 302 both have a plurality of ink cavities 308 storing ink 307 and ink inlets 311 which couple ink cavities 308 to ink supply chamber 310. A large size nozzle 309*a* has a nozzle size larger than a small size nozzle 309*b*. FIG. 4 shows a cross section of small size head portion 302, and large size head portion 301 has a similar structure.

Ink cavities 308 for large head portion 301 and small head portion 302 are formed into elongate grooves extending toward the direction in which large size head portion 301 opposes small size head portion 302 and in parallel to each other. Ink supply chambers 310 as well as ink cavities 308 are formed symmetrically with respect to central line 312, and connected to an ink tank which is not shown.

A thin film of a conductive material is used for partitioning wall 304, which is fixed between channel plate 303 and vibrating plate 305. Partitioning wall 304 is fixed under a prescribed tension.

Vibrating plate 305 includes a piezoelectric element 315 such as a PZT transducer. Conductive metal layers used as a common electrode and a separate electrode are provided on its upper and lower surfaces, respectively. Vibrating plate 305 is fixed to base plate 306 with a conductive adhesive, and then a longitudinal groove 318 and a transverse groove 319 are formed by means of dicing. Vibrating plate 305 is separated by longitudinal groove 318 and transverse groove 319 into piezoelectric element 315 corresponding to each ink cavity 308, a separating wall 316 between adjacent piezoelectric elements 315 and wall 317 surrounding piezoelectric elements 315 and separating wall 316.

The conductive metal layers provided on the upper and lower surfaces of piezoelectric element 315 by means of dicing as described above is also separated by longitudinal groove 318 and transverse groove 319, and the metal layer opposing partitioning wall 304 serves as common electrode 313, and the metal layer opposing base plate 306 serves as separate electrode 314.

Base plate 306 is formed of ceramics, a metal or composite resin. At its surface opposing vibrating plate 305, conductive lead portions are formed corresponding to piezoelectric element 315 in large size head portion 301 and small size head portion 302 by means of a well known technique such as sputtering and vapor deposition. Separate electrode 314 thus formed is electrically connected with a corresponding conductive lead portion through the conductive adhesive. In the region where common electrode 313 and separate electrode 314 oppose, each piezoelectric element 315 is polarized and activated at a high temperature.

In thus formed recording head portions 3*a* to 3*d*, ink supply chamber 310 is supplied with ink 307 from an ink tank of each color which is not shown. Ink 307 in ink supply chamber 310 is distributed to ink cavity 308 through ink inlet 311.

A prescribed voltage is applied across the region between the common electrode 313 and separate electrode 314 of each piezoelectric element 315 in each of recording head portions 3*a* to 3*d*, which causes each piezoelectric element 315 to deform. The deformation of piezoelectric element 315 is transmitted to partitioning wall 304, which pressurizes ink 307 in ink cavity 308, and ink droplets are ejected toward recording sheet 2 through large size nozzle 309*a* or small size nozzle 309*b*. Application of a voltage by a head driving block 620 is selectively performed to piezoelectric element 315 based on image data. Thus, ink of each color is ejected accordingly, and images having color tones are recorded on recording sheet 2.

Figure 5:
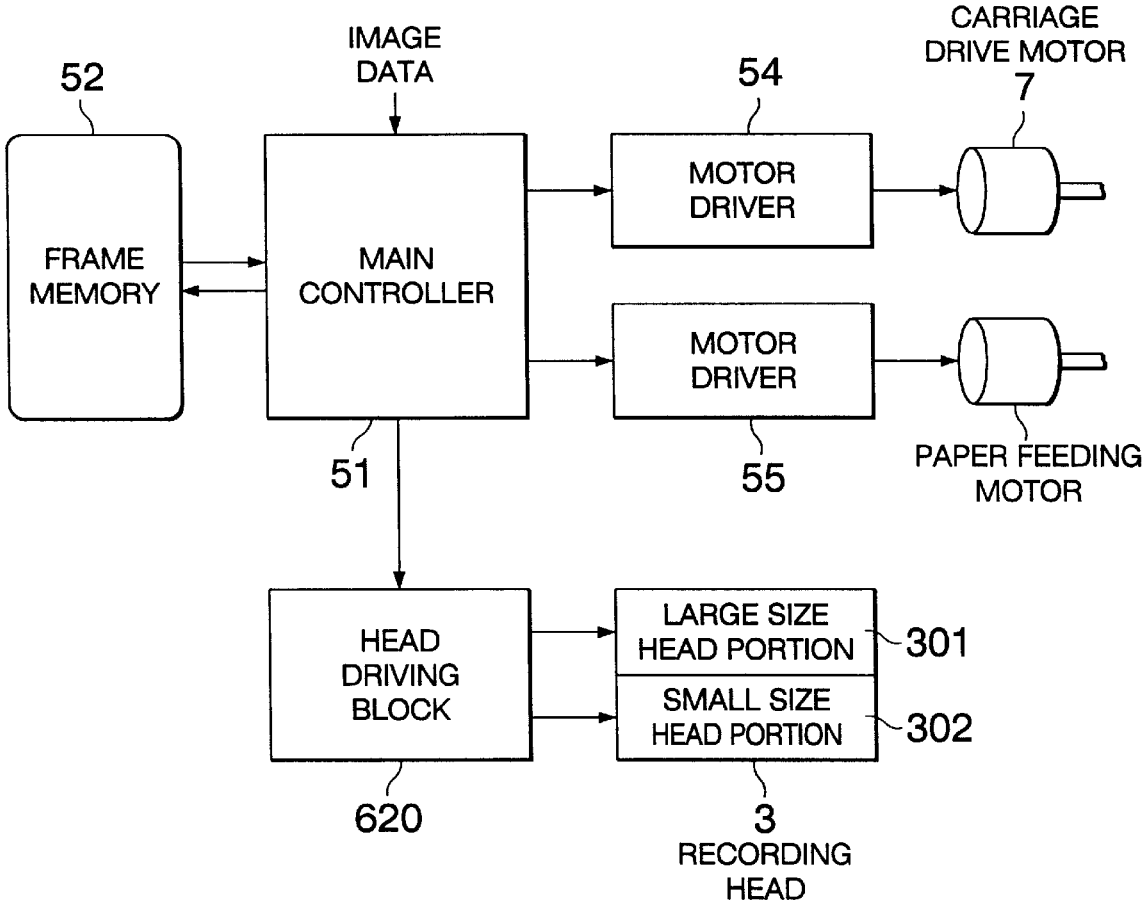
FIG. 5 is a block diagram showing the configuration of a control unit in an ink jet recording apparatus.

FIG. 5 is a block diagram showing the control unit of ink jet recording apparatus 1. A main controller 51 receives image data from a device such as digital camera, image reader and computer, and stores the received data into a buffer frame memory 52 on a one-frame-basis. During recording data to recording sheet 2, main controller 51 controls the drive motor 7 of carriage 4 and a paper feeding motor through motor drivers 54 and 55.

In addition to these driving controls, main controller 51 drives piezoelectric elements 315 in large size head portion 301 and small size head portion 302 in recording head portions 3*a* to 3*d* for each of the four colors, Y, M, C and K through head driving block 620 based on image data read out from frame memory 52.

Figure 6:
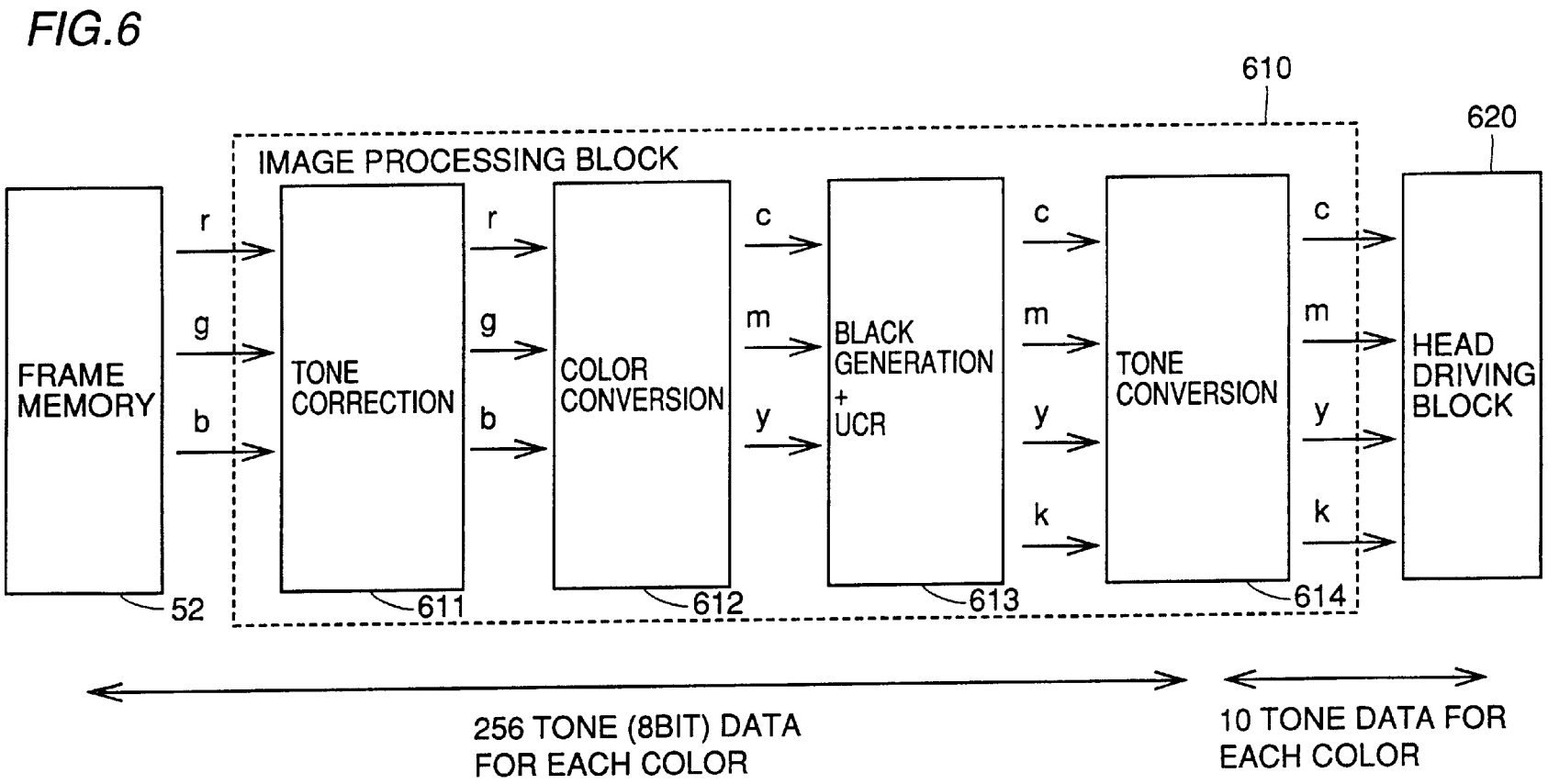
FIG. 6 is a block diagram for use in illustration of an image processing performed in a main controller.

FIG. 6 is a diagram for use in illustration of image processing performed by main controller 51.

In the image processing block labeled 610 in FIG. 6, various image processings performed software-wise to image data by main controller 51 are shown in smaller blocks for the functions.

In image processing block 610 in which images read out from frame memory 52 are input, in tone correction 611, image data is changed so as to have a favorable tone to human eyes and printed based on the inherent toner characteristic of the printer. Then in color conversion 612, input R (red), G (green), B (blue) image data are converted into C (cyan), M (magenta), and Y (yellow) image data. At the time, the color of the image data is converted based on the color of ink to use so that the recorded images are reproduced into favorable colors to human eyes.

Furthermore, black generation+UCR 613, the portion in which three colors, C, M and Y overlap and which is to be recorded in black ink is extracted to generate k (black) image data. Then, in tone conversion 614, 256 tone image data is converted into 10 tone image data.

Herein, from frame memory 52 to tone conversion 614, image data is 256 tone level data represented by 8 bit for each pixel in each color, and from tone conversion 614 to head driving block 620, and image data is 10 tone level data represented by 5 bits for each pixel in each color.

Figure 7:
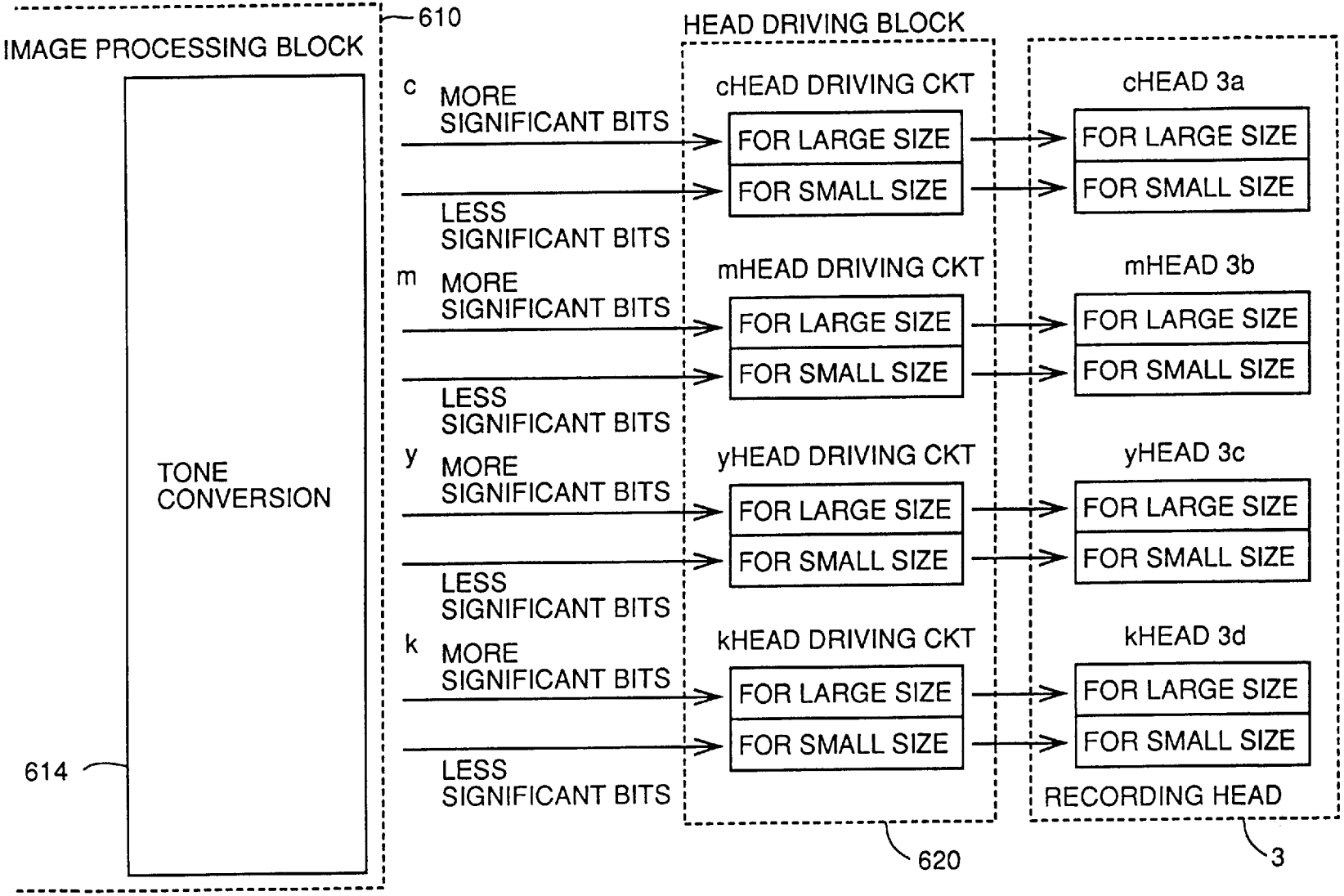
FIG. 7 is a diagram for use in illustration of the flow of data between a head driver and a recording head.

FIG. 7 is a diagram for use in illustration of the flow of data between head driving block 620 and recording head 3.

Figures 8A, 8B:
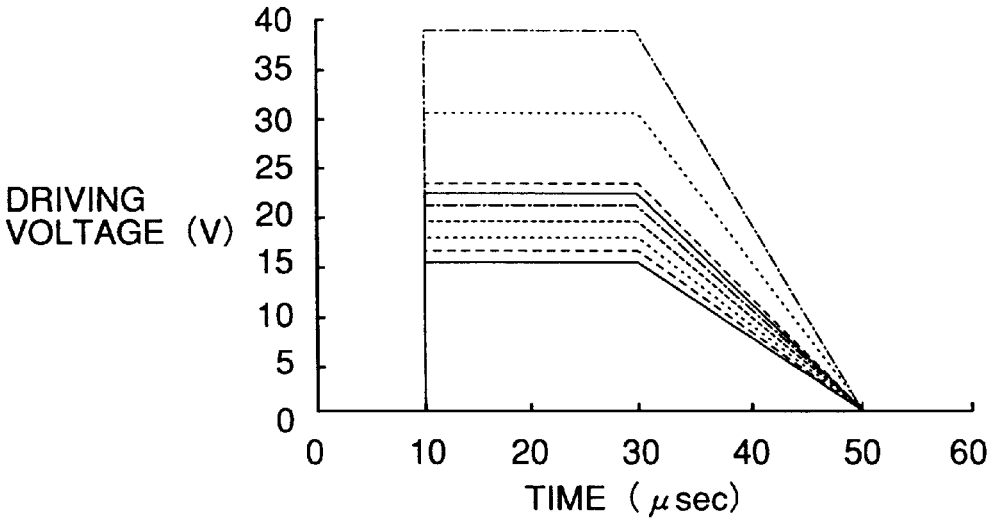
FIGS. 8A and 8B show the relation between tones and driving voltage in the first embodiment of the invention.

After subjected to tone conversion in image processing block 610, image data having tone levels from 0 to 9 levels is input to head driving block 620. Waveform data as shown in FIGS. 8A and 8B corresponding to these tone levels which will be described is read out from a RAM which is not shown, and D/A-converted and a voltage is supplied to recording head 3 accordingly.

In image data having 5 bits for each pixel after the tone conversion, the more significant 2 bits are used as data for driving large size head portion 301, and the less significant 3 bits are used as data for driving small size head portion 302. The more significant 2 bits are therefore input to a driving circuit for the large size head in head driving block 620 and the less significant 3 bits are input to a driving circuit for the small size head. Each of the driving circuits drives each head for a corresponding color to control ejection of ink.

Figure 9:
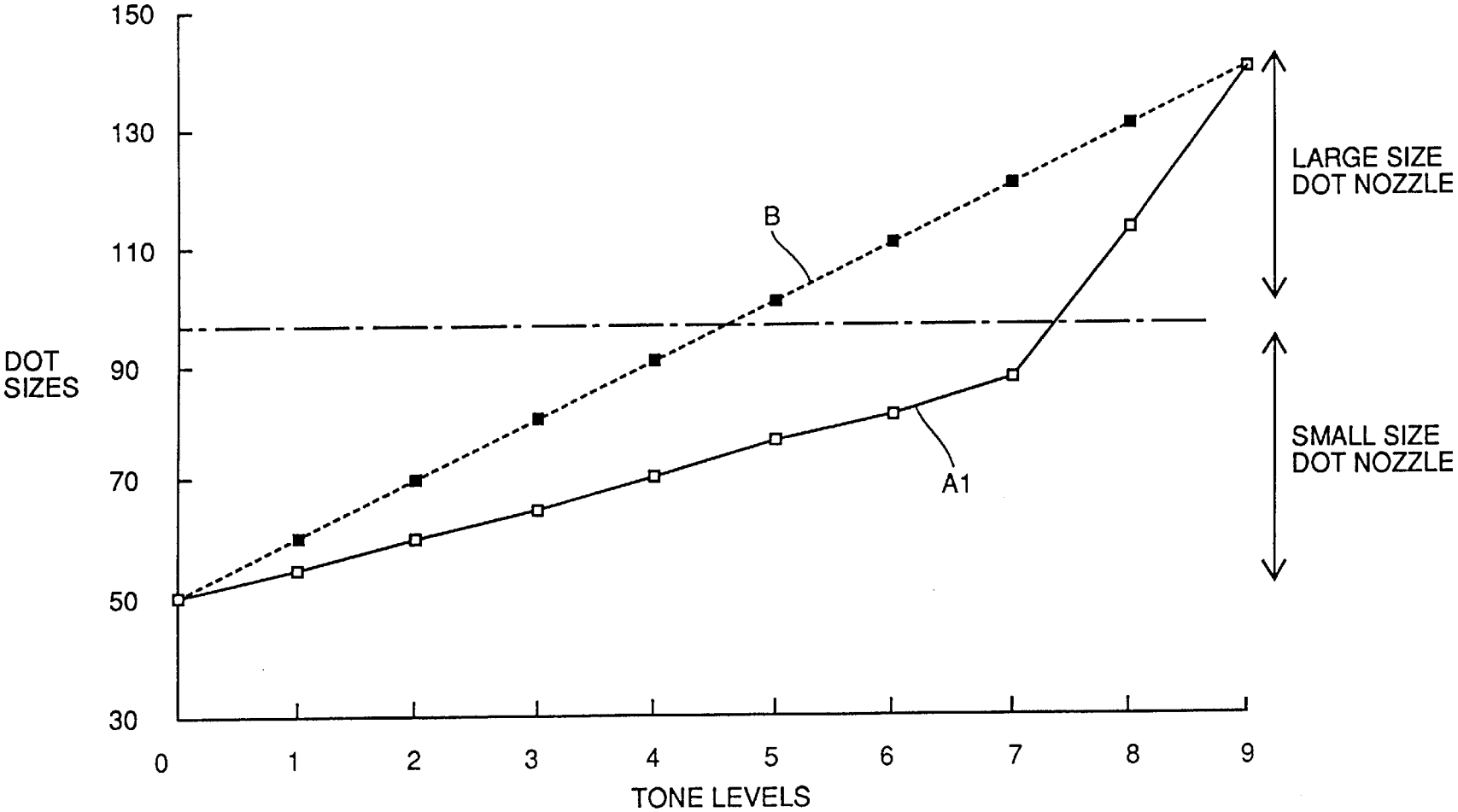
FIG. 9 is a graph showing tones and the dot sizes of ink droplets according to the first embodiment of the invention and a conventional example.

FIG. 9 is a graph specifically showing the relation between tone levels and dot sizes when ink is actually ejected in a condition which will be described, using the ink jet recording apparatus as described above.

As shown in FIG. 9, in the ink jet recording apparatus, tone levels 0 to 7 are allocated to the small size dot nozzle and tone levels 8 and 9 are allocated to large size dot nozzles. The width of change for the dot size per 1 tone level in the range from tone levels 0 to 7 is about 5 $\mu$m. The width of change for the dot size for tone levels of 8 and 9 is about 30 $\mu$m.

Based on the relation between the tone levels represented by image data and the dot sizes of ink droplets, the tones of bright portions in images are represented in more detail and images more acceptable to human eyes are available, without increasing the load of the driver due to increase in tones.

FIG. 8A gives a specific waveform of driving voltage used for establishing such a relation between the tone levels and the dot sizes of ink droplets, while FIG. 8B gives driving voltage peak values.

As shown in FIGS. 8A and 8B, in this embodiment, the dot size of ink droplets is mainly changed by changing the peak value of driving voltage. Note that in this embodiment, the nozzle size of the large dot size head portion is 35 $\mu$m, the nozzle size of small dot size head portion is 30 $\mu$m, the length of each side of a square cross section of the ink inlet is 35 $\mu$m for the large dot size head portion, and 30 $\mu$m for small dot size head portion, and the length of the ink inlet is 300 $\mu$m. The ink used was MAT-1003 manufactured by DIC inc., and superfine sheets manufactured by Seiko Epson Corporation are used as recording sheets. A layered piezoelectric element formed of 25 layers of piezoelectric sheets each having a thickness of 35 $\mu$m is used as the piezoelectric element.

In the foregoing, the ink jet recording apparatus including the large size nozzle and small size nozzle is described as the embodiment, the nozzle sizes may be all the same otherwise. Such a case in which the nozzle sizes are all the same will be now described.

Figure 10:
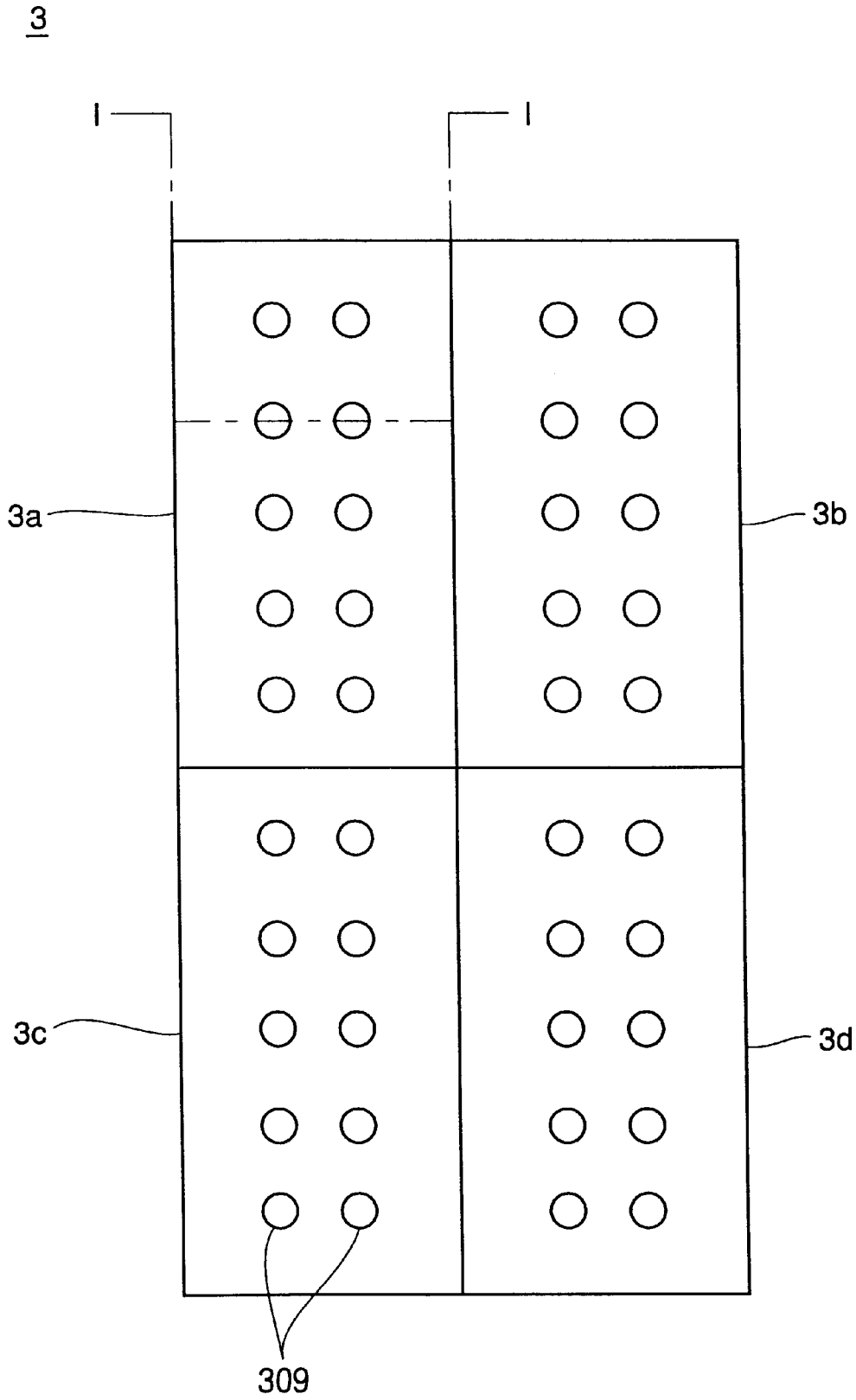
FIG. 10 is a plan view of a recording head 3 in an ink jet recording apparatus according to a second embodiment of the invention.

FIG. 10 is a plan view of a recording head 3 used for an ink jet recording apparatus according to a second embodiment of the invention. As shown in FIG. 10, head portions 3*a* to 3*d* for respective colors each include two rows of nozzles 309 of the same size. In each of the head portions, piezoelectric elements corresponding to nozzles in each row are driven by the same driver. Note that the other structure is the same as that described in conjunction with the first embodiment, and therefore a detailed description will not be provided here.

Figure 11:
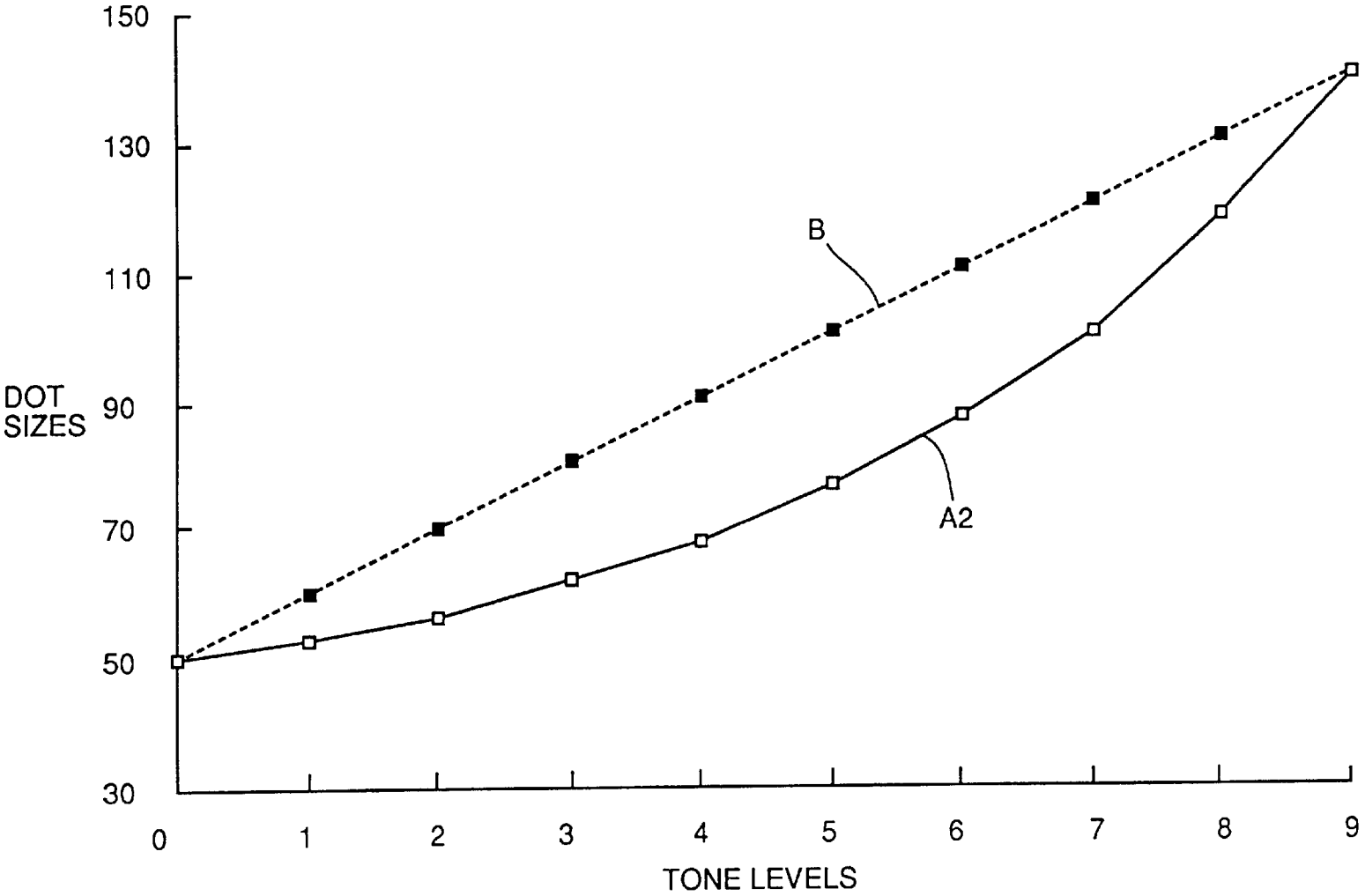
FIG. 11 is a graph showing tones and the dot sizes of ink droplets according to the second embodiment and a conventional example.

FIG. 11 is a graph specifically showing the relation between tone levels and dot sizes when ink is actually ejected in a condition which will be described, using the ink jet recording apparatus according to the second embodiment.

As shown in FIG. 11, in the second embodiment, the width of change of the dot size per 1 tone level increases from lower tone levels to higher tone levels. Based on the relation between tone levels represented by image data and the dot sizes of ink droplets, the tones of brighter portions of images can be represented in more detail, and images smoothly acceptable to human eyes are available, without increasing the load of the driver due to increase in tones. In addition, the embodiment is particularly advantageous in terms of cost, because there are not provided a plurality of kinds of drivers.

Figures 12A, 12B:
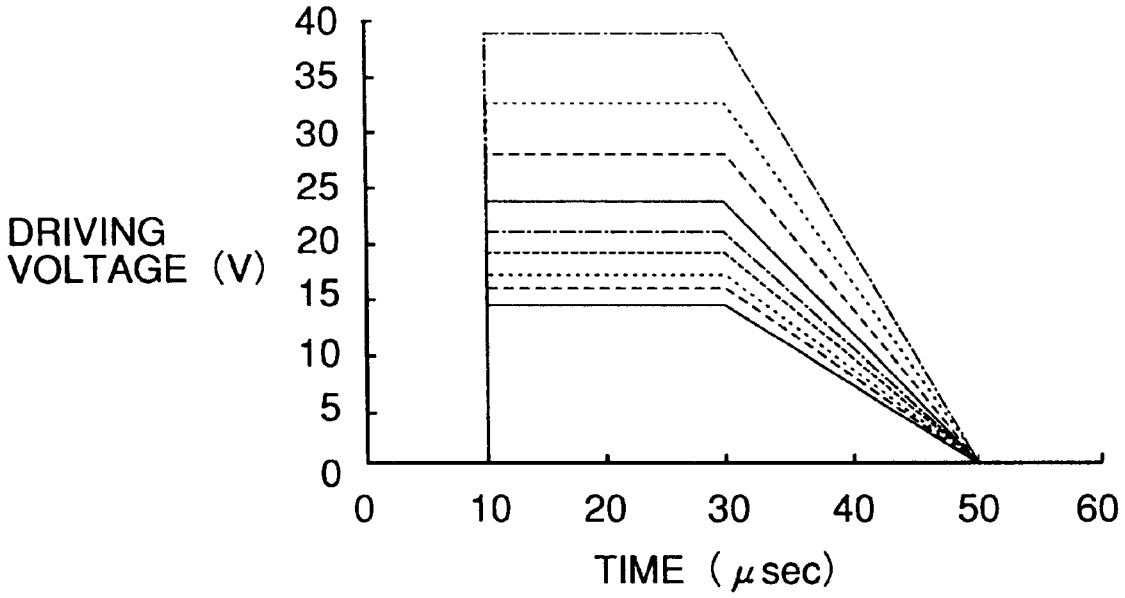
FIGS. 12A and 12B show the relation between tones and driving voltage in the second embodiment of the invention.

FIGS. 12A and 12B are used for illustration of driving voltage used to obtain the relation between tone levels and the dot sizes of ink droplets in the second embodiment. FIG. 12A is a chart showing the waveforms of driving voltages, and FIG. 12B shows the peak values of driving voltage pulses.

As shown in FIGS. 12A and 12B, as is the case with the first embodiment, the dot size of ink droplets is mainly changed by changing the peak value of driving voltage. Note that, in this embodiment, the nozzle size is 30 $\mu$m, the length of each side of a square cross section of the ink inlet is 35 $\mu$m, and the length of the ink inlet is 300 $\mu$m. The use ink was MAT-1003 manufactured by DIC inc. and superfine sheets manufactured by Seiko Epson Corporation was used as recording sheets. A layered type piezoelectric element formed of 25 layers of piezoelectric sheets having a thickness of 35 $\mu$m was used as the piezoelectric element.

Figure 13:
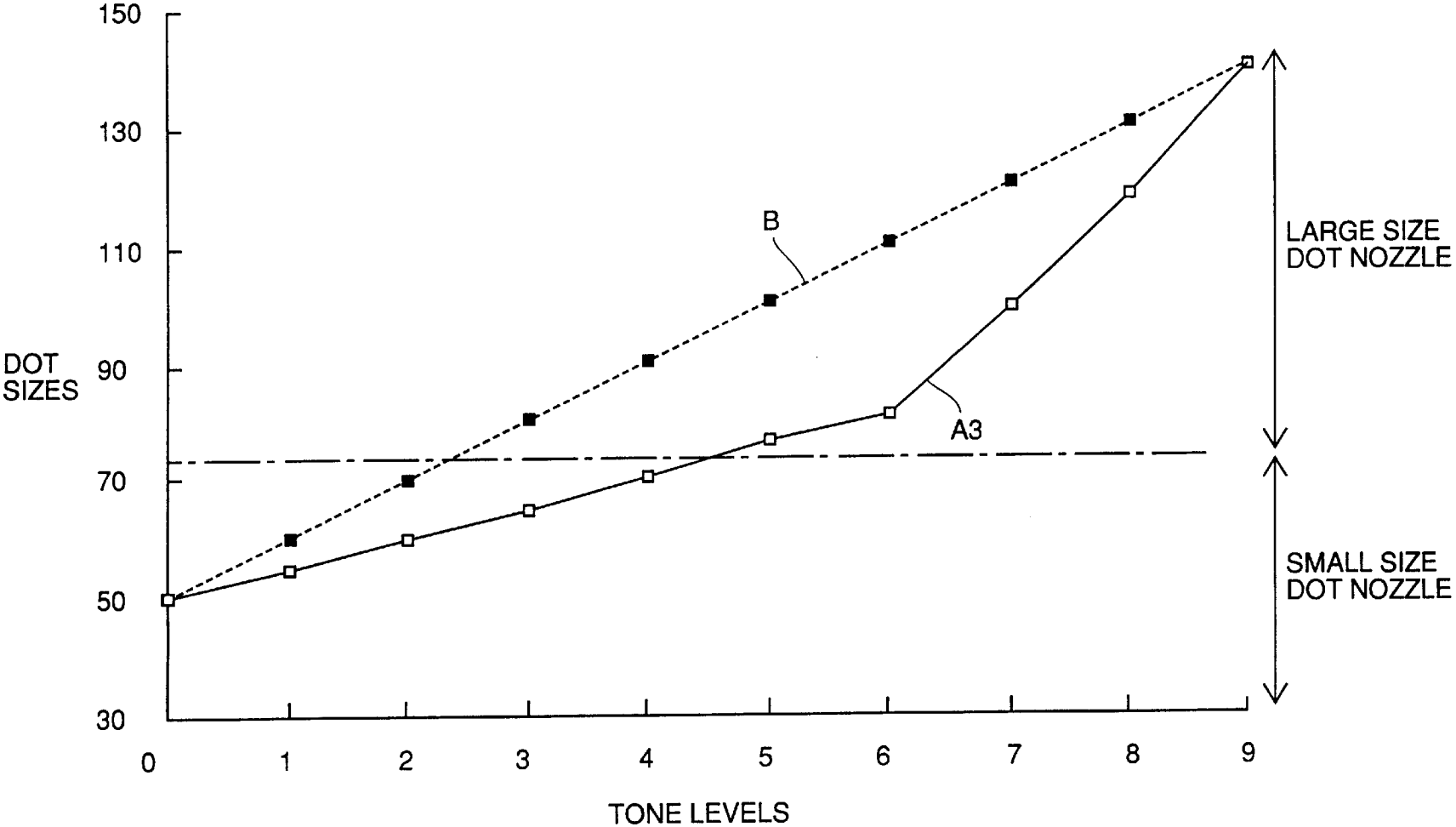
FIG. 13 is a graph showing tones and the dot sizes of ink droplets according to a third embodiment of the invention and a conventional example.

Now, a third embodiment of the invention will be described. In the third embodiment, the variable ranges of dot sizes belonging to nozzles are different between one another within the range without imposing excessive load upon the driver. FIG. 13 shows the relation between tone levels and the dot sizes of ink droplets. In the third embodiment, only the region of low tone levels having a small change width for dot sizes is allocated to the small dot size nozzle, while the variable range of the dot size belonging to the large dot size nozzle is larger. In this embodiment, the same number of tone levels are allocated to the large dot size nozzle and small dot size nozzle, the number may be allocated otherwise.

In the above-described embodiment, one pixel of image data is represented by change in the size of 1 dot by way of illustration, the number of tones represented by changes in the size of 1 dot is limited. In order to further increase the number of tones, one pixel of image data is corresponded to a plurality of dots, and various tones may be represented by changing the sizes of the plurality of dots.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet recording apparatus, comprising:

a printing head; and a driver connected with said printing head, said driver being for applying signals to said printing head, wherein said printing head is capable of ejecting ink droplets onto the recording medium to form dots on a recording medium in any of a plurality of differing dot sizes in response to signals applied by said driver, each dot size in said plurality of differing dot sizes differing from other dot sizes in said plurality of differing dot sizes, wherein said plurality of differing dot sizes includes a low level range of dot sizes and a high level range of dot sizes, with dot sizes in said high level range being larger than dot sizes in said low level range, and wherein a change in dot size between adjacent dot sizes in said low level range is less than a change in dot size between adjacent dot sizes in said high level range.

2. An ink jet recording apparatus in accordance with claim 1, wherein said printing head includes a large size nozzle, for ejecting ink droplets capable of forming large size dots, and a small size nozzle, for ejecting ink droplets capable of forming small size dots, and wherein said small size dots are smaller than said large size dots.

3. An ink jet recording apparatus in accordance with claim 2, wherein said large size nozzle can eject an ink droplet capable of forming a dot size in said high level range, and wherein said small size nozzle can eject an ink droplet capable of forming a dot size in said low level range.

4. An ink jet recording apparatus in accordance with claim 1, wherein as dot size increases from one dot size to a next larger dot size in the plurality of dot sizes, a difference between the one dot size and the next larger dot size increases.

5. An ink jet recording apparatus in accordance with claim 1, wherein changes in dot size between adjacent dot sizes in said low level range are substantially equal to each other, wherein changes in dot size between adjacent dot sizes in said high level range are substantially equal to each other and are greater than changes in dot size between adjacent dot sizes in said low level range.

6. An ink jet recording apparatus in accordance with claim 1, wherein said printing head has a large size head portion, said large size head portion has a plurality of large size nozzles, for ejecting ink droplets having large droplet sizes and said printing head has a small size head portion, wherein said small size head portion has a plurality of small size nozzles, for ejecting ink droplets having small droplet sizes.

7. An ink jet recording apparatus in accordance with claim 1, wherein changes in dot size between adjacent dot sizes in said low level range are substantially equal to each other.

8. An ink jet recording apparatus in accordance with claim 1, wherein changes in dot size between adjacent dot sizes in said high level range are substantially equal to each other.

9. An ink recording apparatus in accordance with claim 1, wherein changes in dot size between adjacent dot sizes in said high level range are greater than changes in dot size between adjacent dot sizes in said low level range.

10. An ink jet recording apparatus for printing out image data having a plurality of tone levels, said ink jet recording apparatus comprising:

a printing head for ejecting ink droplets onto a recording medium, to form dots on the recording medium in any of a plurality of differing dot sizes, and a driver for driving said printing head, wherein said driver can drive said printing head, based on a tone level to be printed, to change the droplet size of an ink droplet to be effected so as to change the dot size of a resulting dot on said recording medium based on the tone level to be printed, wherein said plurality of differing dot sizes includes a low range of dot sizes corresponding to a range of low tone levels and a high range of dot sizes corresponding to a range of high tone levels, with dot sizes in said high range being larger than dot sizes in said low range, and wherein a change in dot size between adjacent dot sizes in said low range is less than a change in dot size between adjacent dot sizes in said high range.

11. An ink jet recording apparatus in accordance with claim 10, wherein said printing head includes a large size nozzle for ejecting ink droplets capable of forming large size dots, and a small size nozzle for ejecting ink droplets capable of forming small size dots, and wherein said small size dots are smaller than said large size dots.

12. An ink jet recording apparatus in accordance with claim 11, wherein said large size nozzle can eject an ink droplet capable of forming a dot having a dot size corresponding to a tone level in said range of high tone levels, and wherein said small size nozzle can eject an ink droplet capable of forming a dot having a dot size corresponding to a tone level in said range of low tone levels.

13. An ink jet recording apparatus in accordance with claim 10, wherein as tone level increases from one tone level to a next larger tone level, a difference between a dot size, corresponding to the one tone level, and a dot size, corresponding to the next larger tone level, increases.

14. An ink jet recording apparatus in accordance with claim 10, wherein changes in dot size between adjacent dot sizes in said low range are substantially equal to each other, wherein changes in dot size between adjacent dot sizes in said high range are substantially equal to each other and are greater than changes in dot size between adjacent dot sizes in said low range.

15. An ink jet recording apparatus in accordance with claim 10, wherein said printing head has a large size head portion, said large size head portion has a plurality of large size nozzles for ejecting ink droplets capable of forming dots, and said printing head has a small size head portion, wherein said small size head portion has a plurality of small size nozzles, for ejecting ink droplets capable of forming dots.

16. An ink jet recording apparatus in accordance with claim 10, wherein changes in dot size between adjacent dot sizes in said low range are substantially equal to each other, and wherein changes in dot size between adjacent dot sizes in said high range are substantially equal to each other.

17. An ink jet recording apparatus in accordance with claim 10, wherein changes in dot size between adjacent dot sizes in said high range are greater than changes in dot size between adjacent dot sizes in said low range.

18. A method of printing in an ink jet recording apparatus, said method comprising the steps of:

inputting image data having a plurality of tone levels;

driving a printing head, based on image data inputted in said step of inputting to eject ink droplets from said printing head, thereby forming ink dots on a recording medium, with each ink dot having a size corresponding to a respective one of said plurality of tone levels; and changing the dot size of an ink dot formed in said step of driving, depending upon the respective tone level to be printed so that changes in dot size between adjacent dot sizes corresponding to a low range of said tone levels are less than changes in dot size between adjacent dot sizes corresponding to a high range of said tone levels.

19. A method of printing in accordance with claim 18, wherein said printing head includes a large size nozzle for ejecting large size ink droplets, and a small size nozzle for ejecting small size ink droplets.

20. A method of printing in accordance with claim 19, wherein a dot having a dot size corresponding to a tone level in said high range is formed by said large size nozzle, and a dot having a dot size corresponding to a tone level in said low range is formed by said small size nozzle.

21. A method of printing in accordance with claim 18, wherein, in the step of changing the dot size, the change in dot size between adjacent dot sizes increases as the tone level to be printed increases.

22. A method of printing in accordance with claim 18, wherein in the step of changing the dot size, changes in dot size between adjacent dot sizes corresponding to said low range of tone levels are substantially equal to each other, and changes in dot size between adjacent dot sizes corresponding to said high range of tone levels are substantially equal to each other and are greater than changes in dot size between adjacent dot sizes corresponding to said low range of tone levels.

23. A method of printing in accordance with claim 18, wherein said printing head has a large size head portion, said large size head portion has a plurality of large size nozzles, for ejecting large size ink droplets, and said printing head has a small size head portion, wherein said small size head portion has a plurality of small size nozzles, for ejecting small size ink droplets.

24. An ink jet recording apparatus comprising:

a printing head for ejecting ink droplets onto said recording medium to thereby form dots on the recording medium; and a driver connected with said printing head to apply signals to said printing head, wherein said printing head is capable of ejecting ink droplets of varying size to form dots of varying size which correspond to respective density levels of signals applied to said printing head by said driver, wherein a change in dot size between dot sizes corresponding to adjacent density levels in a highlight density range is smaller than a change in dot size between dot sizes corresponding to adjacent density levels in a shadow density range.

25. An ink jet recording apparatus in accordance with claim 24, wherein, in both the highlight density range and the shadow density range, as a density level becomes darker, a change in dot size between dot sizes corresponding to adjacent dots becomes larger.

26. An ink jet recording apparatus in accordance with claim 24, wherein changes in dot size between dot sizes corresponding to adjacent density levels in said highlight density range are substantially equal to each other, and wherein changes in dot size between dot sizes corresponding to adjacent density levels in said shadow density range are substantially equal to each other.

27. An ink jet recording apparatus comprising:

a first print head including a first nozzle from which ink droplets are operatively ejected, said first nozzle having a first diameter;

a second print head including a second nozzle from which ink droplets are operatively ejected, said second nozzle having a second diameter that is greater than the first diameter;

a driver, connected to said first print head and said second print head, capable of (i) controlling said first print head at a plurality of levels to eject ink droplets from said first nozzle onto a recording medium to form dots on the recording medium in any of n different dot sizes and (ii) controlling said second print head at a plurality of levels to eject ink droplets from said second nozzle onto a recording medium to form dots on the recording medium in any of m different dot sizes, wherein n and m are natural numbers, and m is less than n.

28. An ink jet recording apparatus in accordance with claim 27, wherein m is at least 3.

29. An ink jet recording apparatus in accordance with claim 27, wherein any one of the n different dot sizes ejectable by the first print head is smaller than any one of the m different dot sizes ejectable by the second print head.

30. An ink jet recording apparatus in accordance with claim 27, wherein a change in dot sizes between adjacent dot sizes among the n different dot sizes is less than a change in dot size between adjacent dot sizes among the m different dot sizes.

31. An ink jet recording apparatus in accordance with claim 30, wherein as dot sizes increase from one dot size to a next larger dot size for at least one of the m different dot sizes and the n different dot sizes, a size difference between adjacent dot sizes increases.

32. An ink jet recording apparatus in accordance with claim 30, wherein changes in dot size between adjacent dot sizes in the n different dot sizes are substantially equal to each other, and wherein changes in dot size between adjacent dot sizes in the m different dot sizes are substantially equal to each other and are greater than changes in dot size(s) between adjacent dot size(s) in the n different dot sizes.

* * * * *